US007401608B2

(12) United States Patent
Sheliga

(10) Patent No.: US 7,401,608 B2
(45) Date of Patent: Jul. 22, 2008

(54) ARCHERY BOW HANDLE WITH OVERHANG ADVANTAGE

(76) Inventor: Douglas J. Sheliga, 11950 Taylor Wells Rd., Chardon, OH (US) 44024

( * ) Notice: Subject to any disclaimer, the term of this patent is extended or adjusted under 35 U.S.C. 154(b) by 43 days.

(21) Appl. No.: 11/251,693

(22) Filed: Oct. 17, 2005

(65) Prior Publication Data

US 2007/0084453 A1 Apr. 19, 2007

(51) Int. Cl.
*F41B 5/00* (2006.01)

(52) U.S. Cl. ..... 124/88; 124/23.1

(58) Field of Classification Search ..... 124/23.1, 124/25.6, 86, 88
See application file for complete search history.

(56) References Cited

U.S. PATENT DOCUMENTS 3,176,674 A * 4/1965 Smith ..... 124/23.1
4,966,124 A 10/1990 Burling
5,333,595 A * 8/1994 Heffron ..... 124/88
5,469,834 A 11/1995 Higgins et al.
5,615,663 A 4/1997 Simonds
6,662,798 B1 12/2003 Johnson

* cited by examiner

*Primary Examiner*—John Ricci

(57) ABSTRACT

The archery bow handle with overhang advantage contains an overhanging structure on the handle that fits into the lifeline area of the archer's bow hand. The radius of the structure is about that of a large pencil. The handle has advantages of allowing the archer to find a consistent hand position on the handle, of forcing the archers bow hand and bow arm into a fixed position, of steadying the bow during aiming, and of allowing the archer to grip the bow during the shot which is a stabilizing effect.

2 Claims, 1 Drawing Sheet

THREE VIEWS OF BOW HANDLE

FIGURE 1. THREE VIEWS OF BOW HANDLE
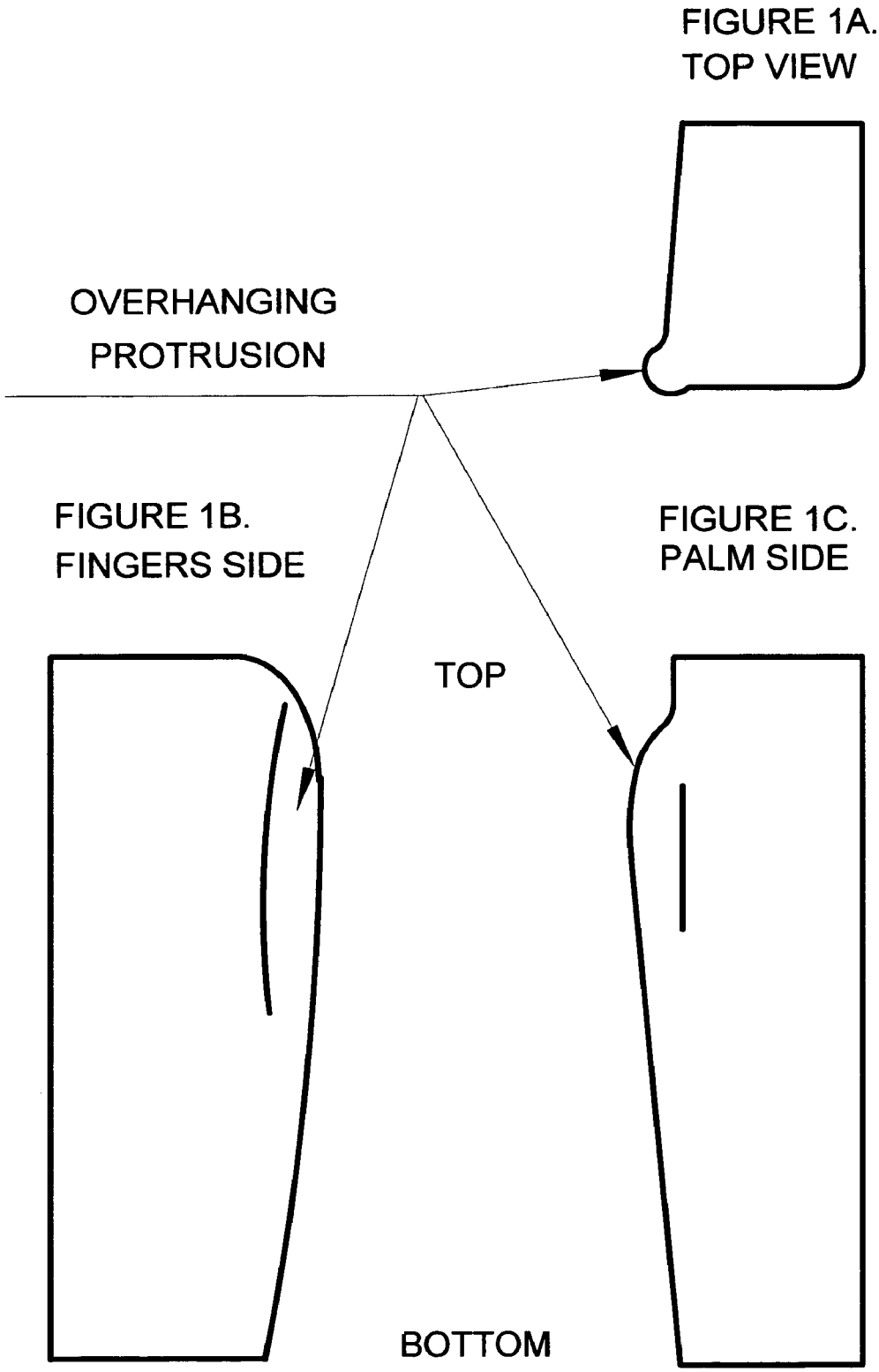

ARCHERY BOW HANDLE WITH OVERHANG ADVANTAGE

CROSS-REFERENCE TO RELATED APPLICATIONS

Not Applicable

STATEMENT REGARDING FEDERALLY SPONSORED RESEARCH OR DEVELOPMENT

Not Applicable

INCORPORATION-BY-REFERENCE OF MATERIAL SUBMITTED ON A COMPACT DISC

Not Applicable

BACKGROUND OF THE INVENTION

1. Field of the Invention

The sport of archery includes target shooting and hunting. In both cases the prime endeavor is use an archery bow to shoot an arrow as accurately as possible to hit what is being aimed at.

2. Description of the Prior Art

Over the years, the sport of archery is becoming more and more a precision shooting experience. Perfect scores are being shot on smaller and smaller targets. These most recent accomplishments require much effort into understanding and tuning the equipment, practice and good equipment. There are certain aides, such as a compound bow and mechanical release etc., that have been introduced over the years that make the task a little easier. Since the archer has only two points of contact with the archery bow, the bow handle and the string, it stands to reason improvements in either interface will ease the efforts. Handles on bows have been very slightly modified over the years without significant improvement in scores. It has been common for the better archers of today to completely remove the handle appendage from the bow and set the hand directly on the rectangular structure that was used to support the handle. Other archers add small structures, for example at the palm of the handle, to better feel an exact pressure point in order to achieve the consistency required for best performance.

The following patents discuss bow handles. U.S. Pat. No. 6,662,798 describes a bow and handle combination of which the handle rotates about a built in bow cylinder and the handle can be customized to fit the archers hand. U.S. Pat. No. 5,615,663 describes an archery bow grip with an improved adjustable grip comprising a thumb side plate and a finger side plate moveable with respect to each other. U.S. Pat. No. 5,469,834 describes an archery bow with tilting and translating grip that can move from side to side and tilt. U.S. Pat. No. 4,966,124 describes a grip assembly for an archery bow for being installed on the riser of a bow to provide a frictionless pivot connection between the bow and the grip and which does not impart torque to the bow. Forty Eight other related U.S. patent numbers were searched for TTL/(bow AND (handle OR grip)). None of the above patents relate to the handle shape presented in this application.

BRIEF SUMMARY OF THE INVENTION

The archery bow handle with the overhang advantage is another improvement option for the archer to achieve the best performance. The new handle is generally convex instead of concave like the old style. It does contain a protrusion, about the size of a half round pencil, that fits into the area of the life line of the archers hand. The protrusion is felt by the archer as an exact repeatable pressure point with the bow hand.

BRIEF DESCRIPTION OF THE DRAWINGS

FIG. 1 shows three views of the improved archery bow handle containing the overhanging protrusion. Only the handle of the archery bow is shown as if it was cut out of the bow. It is shown for a right handed archer whose left hand would be in contact with the handle. The overhanging protrusion fits into the upper life line area of the left hand of the archer. The overhanging protrusion would be on the other side of the handle for a left handed shooter.

FIG. 1A shows the top view of the handle. The overhanging protrusion extends into both the fingers side and the palm side of the handle.

FIG. 1B shows the fingers side of the handle. The overhanging protrusion tapers into the bottom of the handle.

FIG. 1C shows the palm side of the handle. The overhanging protrusion is tapers into the bottom of the handle.

DETAILED DESCRIPTION OF THE INVENTION

The archery bow handle with overhang advantage can be an integral part of the archery bow or a replaceable appendage to the bow. Finished wood seems to be a good material for the handle but it can be made of many other types of material.

The overhanging protrusion, or overhang for short, is shown in FIG. 1. The overhang can be an integral part of the handle or can be a movable appendage on the handle.

The position of the overhang is such that it will fit into an archers hand comfortably when the bow is fully drawn, called full draw. The handle does not feel like an advantage before the bow is drawn, but, at full draw the archer will experience a slightly dominant feel of the overhang.

The size of the overhang varies with the size of the archer's hand. The handle and overhang can be manufactured larger or smaller as necessary. The half round shape of the overhang is about the diameter of a pencil or slightly larger. It is a size to fit comfortably into the life line area of an archer's hand.

The shape of the handle in general is slightly convex which is like the shape of the inside of the hand when holding something.

The overhang does taper into the bottom of the handle. The taper becomes an advantage to the extent that a smaller hand is more comfortable lower on the handle, but, if the hand goes too low than the manufactured size again becomes an option.

One can experience the advantage of the overhang If one tries to hold a pencil with the life line area of the left hand and pretend they are pushing on an archery bow. The left hand and arm seems to lock in place which is good for archery accuracy. If the pencil is moved to the base of the thumb, which more closely resembles the position of older style handles, one finds the left hand and arm do not lock into any one particular position. Also note by using the overhang that the pressure point on the overhang, the pencil position, is more toward the back of the bow hand making the gripping action more stable.

A good fit for which to design the handle can be explained as follows: The index finger on the archers bow hand has an outer index knuckle on the outside of the hand and an inner index knuckle, actually the same knuckle, on the inside of the hand. With the overhang correctly positioned in the archers bow hand, the inner index knuckle will touch the fingers side of the handle.

A good position for which to design the handle can be explained as follows: The archer should hold his bow arm, left arm for right hand shooter, out with the thumb at the top, and then rotate the wrist and lock it in the up position and also rotate the wrist to lock it in the back, towards knuckles, position. These locked positions represent a good solid structure to support the archery bow. The bow handle should comfortably be experienced in this position.

Bow torquing is an evil in archery. The bow should assume a constant position until the arrow leaves. Existing handles lean towards being very narrow so that the archer cannot put any static torque on the handle, but, when the arrow is released the bow will turn, dynamic torque, according to forces applied by the arrow leaving the bow. The hand placement on the narrow handle cannot prevent the bow from turning. The archery bow handle with overhang advantage will apply static torque, a disadvantage, that can be easily overcome by putting a second rear type sight on the bow, not a peep sight, that will aid in aligning the bow for precision sighting. This alignment of the bow sight and the rear sight becomes easier with the overhang handle than with the old narrow handle. Then when the arrow is released the overhang is captured in the bow hand which helps prevent dynamic torque and thus mitigates the turning of the bow in the hand.

Gripping the bow is another issue. The older style handles require a loose grip by the bow hand on the handle and some sort of rope or other accessory to keep the bow from flying out of the hand upon release. The improved handle can be held as tight as the archer wants and still maintain consistency in shooting.

Experience from actual use of the overhang indicates that the archery bow can be held steadier which makes the aiming process easier.

I claim:

1. An archery bow handle, having four sides;

a first side facing an archer as the bow is held in a firing position, and which accommodates the palm of the archer's bow hand;

a second side facing away from an archer;

a third side which accommodates four fingers of the archer's bow hand;

and a fourth side which accommodates the thumb of the archer's bow hand;

each side defining an outer surface;

the first side and the third side intersecting at a corner;

an overhanging protrusion extending from the corner of the first side and third side, the protrusion extending beyond the outer surface of the first side and third side, and having a rounded surface which extends over a substantial length of the handle, a cross section of the protrusion having a maximum diameter of about one-half inch.

2. The archery bow handle of claim 1, in which the protrusion tapers toward the handle, above and/or below the point of a maximum diameter of about one-half inch.

* * * * *